US011180347B2

(12) United States Patent
Foster

(10) Patent No.: US 11,180,347 B2
(45) Date of Patent: Nov. 23, 2021

(54) APPARATUS AND SYSTEM FOR SAFE MANIPULATION AND REMOVAL OF HIGHWAY GUARDRAIL

(71) Applicant: Richard Layne Foster, Craig, CO (US)

(72) Inventor: Richard Layne Foster, Craig, CO (US)

( * ) Notice: Subject to any disclaimer, the term of this patent is extended or adjusted under 35 U.S.C. 154(b) by 220 days.

(21) Appl. No.: 16/501,870

(22) Filed: Jun. 21, 2019

(65) Prior Publication Data

US 2020/0399096 A1 Dec. 24, 2020

(51) Int. Cl.
*B66C 1/14* (2006.01)
*E01F 15/02* (2006.01)

(52) U.S. Cl.
CPC ..... *B66C 1/14* (2013.01); *E01F 15/02* (2013.01)

(58) Field of Classification Search
CPC ..... B66C 1/14
USPC ..... 294/82.13
See application file for complete search history.

(56) References Cited

U.S. PATENT DOCUMENTS 752,879 A * 2/1904 Ashland ..... B25D 1/04 254/26 R
1,813,313 A * 7/1931 Offutt ..... A24F 19/14 131/256
2,616,746 A * 11/1952 Chapman ..... B66F 13/00 294/82.13
2,702,714 A * 2/1955 Moses ..... B60D 1/187 280/505
2,983,542 A * 5/1961 Shull ..... B66C 1/422 294/82.13
3,794,192 A * 2/1974 Monson ..... B60P 1/5428 414/541
D444,690 S * 7/2001 Bond ..... B66F 15/00 D8/16
6,601,892 B2 * 8/2003 Scarborough ..... B66C 1/30 294/103.1
D702,101 S * 4/2014 Vanderbeek ..... D8/89

FOREIGN PATENT DOCUMENTS

GB 104262 A * 3/1917 ..... B66C 1/14

* cited by examiner

*Primary Examiner* — Michael McCullough

(57) ABSTRACT

A significant improvement over existing devices and methods for lifting highway guardrail and similar bulky and heavy objects, this invention comprises a combination prying and lifting device (20) having a cable component (24) which has at one end a hook device (44) for grasping the guardrail panel (21) and has at the other end a component (30) for grasping the edge of the guardrail. This invention provides workers with significant protection from various types of injuries associated with isolating, lifting, installing and removing guardrail panels.

11 Claims, 10 Drawing Sheets

APPARATUS AND SYSTEM FOR SAFE MANIPULATION AND REMOVAL OF HIGHWAY GUARDRAIL

CROSS REFERENCE APPLICATIONS

This application is a non-provisional application claiming the benefits of Provisional Application No. 62/763,566 filed Jun. 21, 2018.

FIELD OF INVENTION

The present invention relates to highway guardrail panel support devices that attach directly to the highway guardrail panel and are in turn mechanically lifted and/or held by another secondary lifting device, such as a crane, front end loader, skid steer loader, tractor, etc.

BACKGROUND OF THE INVENTION

There exists a variety of techniques, tools and devices that are currently used for installing highway guardrail panels. These techniques, tools and devices include those used to 1) separate panels from other panels, 2) attach to the panels, 3) lift the panels, 4) rotate the panels to a horizontal/plumb position, 5) support the panels while they are moved into a position for attachment and installation onto road side posts, other guardrail panels, guardrail terminal components, etc. and 6) remove the damaged panels that are being replaced.

Although these techniques, tools and devices are currently considered to be the most modern devices and methods available, they still require that the panels be manipulated using human lifting and that workers' fingers and hands are in places that expose them to the risk of bodily injury during the movement of the guardrail panels. These potential injuries include strained or torn muscles, ligaments or tendons as well as crushed or pinched fingers, hands, toes, or feet. A solution is a device that isolates, attaches to, lifts, supports, and positions the guardrail panels while minimizing or eliminating the risk of bodily injury to workers. The present invention is such a device.

There are a number of patented and public domain devices that are used to separate guardrail panels that are stacked together, such as pry bars (e.g. design Pat. No. U.S. D 444,690 to William Ralph Bond on Jul. 10, 2001 and design Pat. No. D702,101 to Karl Vanderbeek on Apr. 8, 2014), and hammers (e.g. Pat. No. 752,879 to Ezekiel A. Ashland on Feb. 23, 1904).

When used to separate heavy guardrail panels, these prior art devices isolate the panels in a limited capacity still requiring additional involvement using the workers' hands and forgers, exposing them to the risk of injury, including pinching, crushing, etc. A solution reducing or eliminating these hazards would be a device that separates the panels and attaches to them for lifting, in such a way that does not require the worker's hands and fingers be placed under or between the guardrail panels.

Additionally, there are a number of issued patents for devices that can be directly or indirectly attached to guardrail panels so they can be lifted into position for installation. These devices include chain hooks (e.g. U.S. Pat. No. 1,818,813 to Netz Fritz on Aug. 11, 1931) and pick-up truck- or trailer-mounted cranes (e.g. U.S. Pat. No. 3,794,192 to Charles D. Monson on Feb. 25, 1974).

With the use of these devices there still exists the risk of bodily injury (such as strained or torn muscles, ligaments, and/or tendons) to the workers resulting from lifting the panels, which can weigh up to 245 pounds each.

In the process of using these devices, the guardrail panels must still be manipulated into a position in which the device can be attached to them. A solution to this problem would be a device that lifts, supports and moves the panels while minimizing or eliminating the risk of bodily injury.

Some of these same patented devices also are used for supporting the guardrail panels. However, none of the devices performs all of the steps required to attach to, separate, lift, rotate to a horizontal/plumb position and position the panels to roadside posts, adjoining guardrail panels and guardrail terminal components.

The above mentioned inventions each present significant limitations involving the worker lifting the guardrail panels so that the various devices and secondary lifting equipment can be used.

A solution to the various problems, challenges and risks associated with roadside guardrail installation would be a device that isolates, attaches to, lifts and positions the panels while minimizing or eliminating the risk of bodily injury. The present invention is such a device.

SUMMARY OF THE INVENTION

The primary advantages of the present invention are:

a) to provide a combination pry bar and book component mechanically associated with a cable, guardrail book assembly and upper cod loop for mechanical attachment to a secondary lifting device such as a crane, skid steer, loader, tractor, etc.

b) to provide a means by which a single guardrail panel can be separated from other guardrail panels or other surfaces without a person's hands or fingers being between or beneath the guardrail panels, thus preventing crushing or pinching of the hands, fingers, feet or toes.

c) to provide a means by which the guardrail panel is lifted and supported by the various components of the present invention. It is designed so that, when lifted, the guardrail's weight securely holds the present invention's components in place, relative to the lifted guardrail panel and to the other components of the present invention.

d) to provide, with its design, a means by which the present invention cannot be attached to more than one guardrail panel at a time. This design feature prevents the hook from being loaded with more guardrail panels than it is designed to safely lift and support.

Design creates a self-limiting grasp onto the guardrail panel. The limiter element of combination prying bar/book creates an angle of the plying element that cannot reach additional guardrail panels. The angle designed into the prying element portion of the combination pry bar/hook prevents the prying element from being entirely inserted through the guardrail panels' bolt holes, thus preventing its attachment to more than one panel.

e) to provide a means by which the various components of the present invention can be attached to a section of guardrail, which is lifted and held by a secondary lifting device such as a crane, skid steer loader, other type of loader or tractor, thus eliminating the need for manual lifting by workers, resulting in the reduced risk of bodily injury.

f) to provide a means by which the cable is a flexible wire rope cable and may optionally be a coated wire rope cable protecting the workers' hands and fingers from puncture wounds caused by broken wires.

g) to provide a means by which the cable component is held in place preventing shifting of the suspended load, thus providing further protection of workers and other equipment. This feature accomplishes the task of holding the cable component while splitting the weight of the load and channeling the weight around the cable, thus not reducing the combination pry bar/hook's lifting capacity.

h) to provide a means by which the cable component is protected from premature wear.

i) to provide a means by which the guardrail panel, when lifted, is rotated into a plumb position which is required for roadside installation, thus eliminating the need for additional adjustment.

j) to provide a means by which the guardrail panel can be positioned where it can be attached to existing roadside posts, adjacent guardrail panels and guardrail terminal components for its final installation.

k) to provide a means by which damaged guardrail panels can be manipulated during their removal from their roadside installations and placed onto a trailer or truck bed for removal from the worksite.

In accordance with the preferred embodiment, a combination prying and lifting device comprises a combination pry bar/hook, limiter element, cable component and guardrail hook assembly. These components collectively have a capacity to support a new guardrail panel for a roadside installation and/or for the removal of a damaged guardrail panel. When used with a secondary lifting device, the various components of the present invention mechanically associate with each other to attach to and support the guardrail panel so as to not require human lifting of the panel or to require that the workers' hands or fingers be placed in a position in which they might be crushed or pinched.

Other aspects of this invention will appear from the following description and claims, reference being made to the accompanying drawings forming a part of this specification wherein similar reference characters designate corresponding parts in the several views.

BRIEF DESCRIPTION OF THE DRAWINGS

FIG. 6 is a top view of the 3-stage procedure of separating a single guardrail panel and attaching the present invention in order to lift the panel.

DRAWINGS—REFERENCE NUMERALS

20 Combination Prying And Lifting Device
21 Highway Guardrail Panel
23 Upper End Loop
24 Cable
25 Cable Thimble
30 Guardrail Hook Assembly
31 Guardrail Edge Hook
32 Cable Clamp/Ferrule
33 Guardrail Attachment Slot
40 Combination Pry Bar/Hook
41 Barrel
42 Cable Guide
43 Limiter Element At First End
44 Prying Element At Second End
45 Guardrail Stack
50 Handle Saddle
51 Channel
52 Bolt
53 Nut
54 Back Plate
55 V-Plate Top
56 V-Plate Bottom
57 V-Plate Spacer
58 Ring

DETAILED DESCRIPTION

Figure 1:
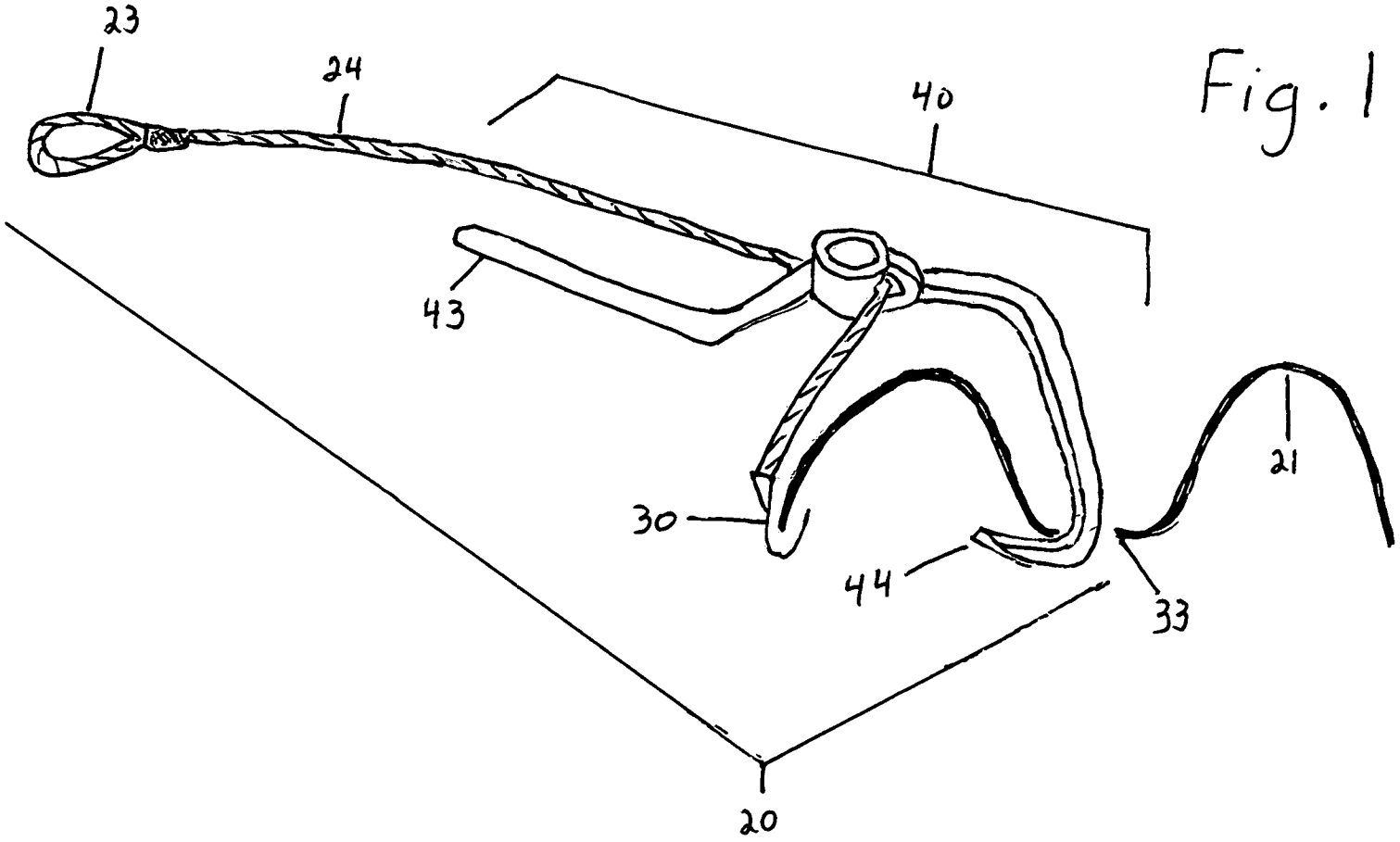
FIG. 1 is an assembled view of the preferred embodiment of the combination prying and lifting device.

FIG. 1 details the Combination Prying And Lifting Device 20 as it attaches to a Highway Guardrail Panel 21. The Prying Element 44 is inserted into the Guardrail Attachment Slot 33 and the Guardrail Hook Assembly 30 is attached to the edge of the Highway Guardrail Panel 21. These two components attach to the Guardrail Panel 21 to facilitate lifting by Upper End Loop 23.

Figure 2:
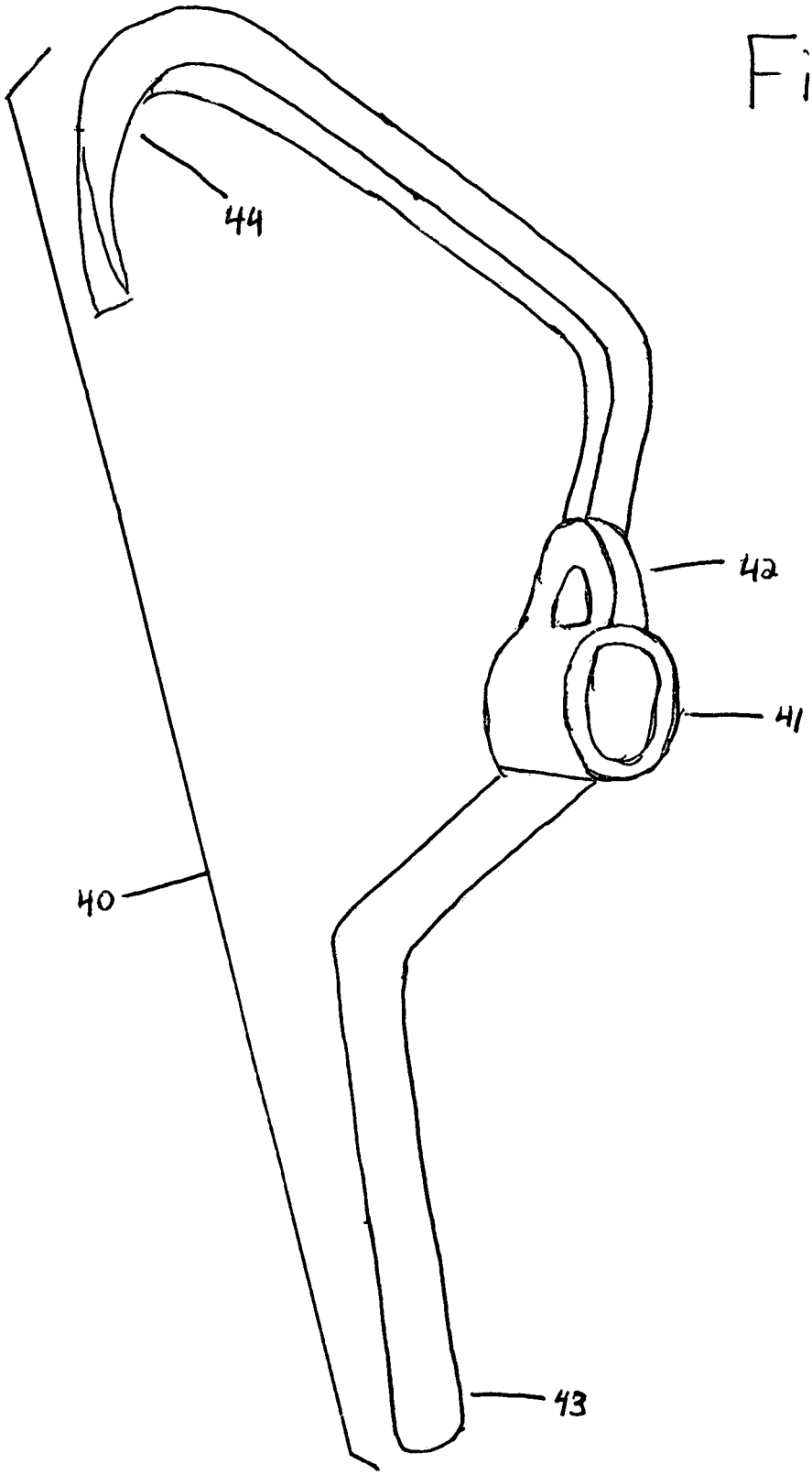
FIG. 2 is a 3/4 view of the Combination Pry Bar/Hook component.

FIG. 2 shows the various components of the assembled Combination Pry Bar/Hook 40. The Prying Element 44 portion is shaped in such a way so as to limit attachment to only one Guardrail Panel at a time. Working in concert with Limiter Element 43. The Cable Guide 42 securely envelops the Cable that is attached to the Combination Pry Bar/Hook and allows the weight of the load to be centered on the hook. The cable passes around the Barrel 41. The Barrel 41 is designed with a radius large enough to prevent premature cable wear as a result of too sharp or abrupt of turn under load or crimped in such a way as to damage it.

Figure 3:
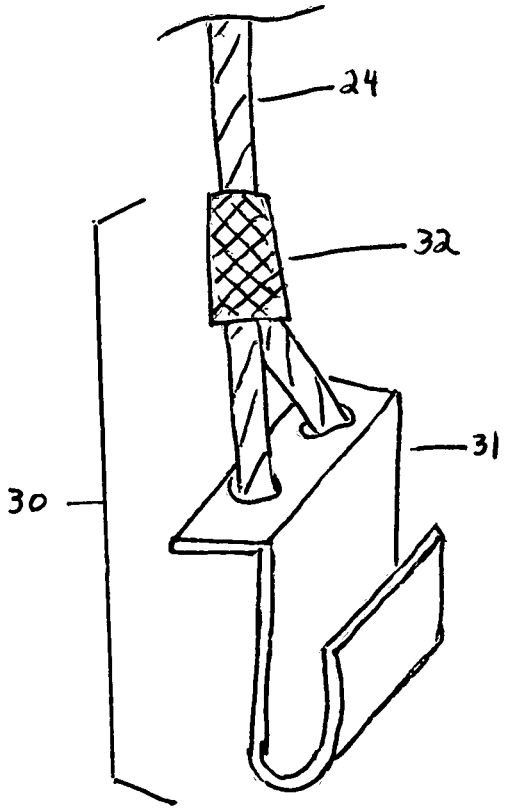
FIG. 3 is a 3/4 view of one embodiment of the assembled guardrail hook assembly.

FIG. 3 shows the 3/4 view of the assembled Guardrail Hook Assembly 30. Notice that it protects the cable component from damage that may otherwise occur when an object comes into contact with the cable severing its wires.

Figure 4:
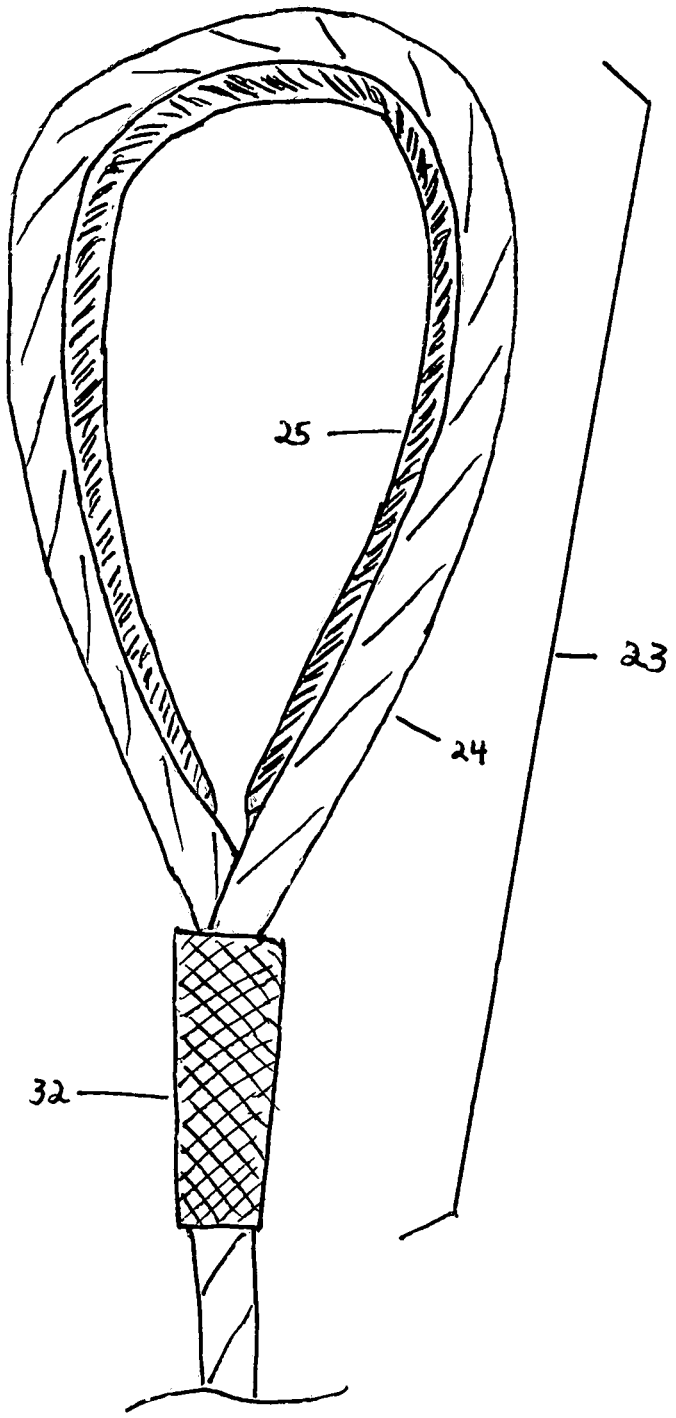
FIG. 4 is a front view of the upper end loop of the cable that is to be attached to a secondary lifting device.

FIG. 4 presents an assembled view of the Upper End Loop 23. Showing Cable 24 securely wrapped around Cable Thimble 25. Cable Clamp/Ferrule 32 affixes around Cable Thimble 25 holding it securely in place.

Figure 5:
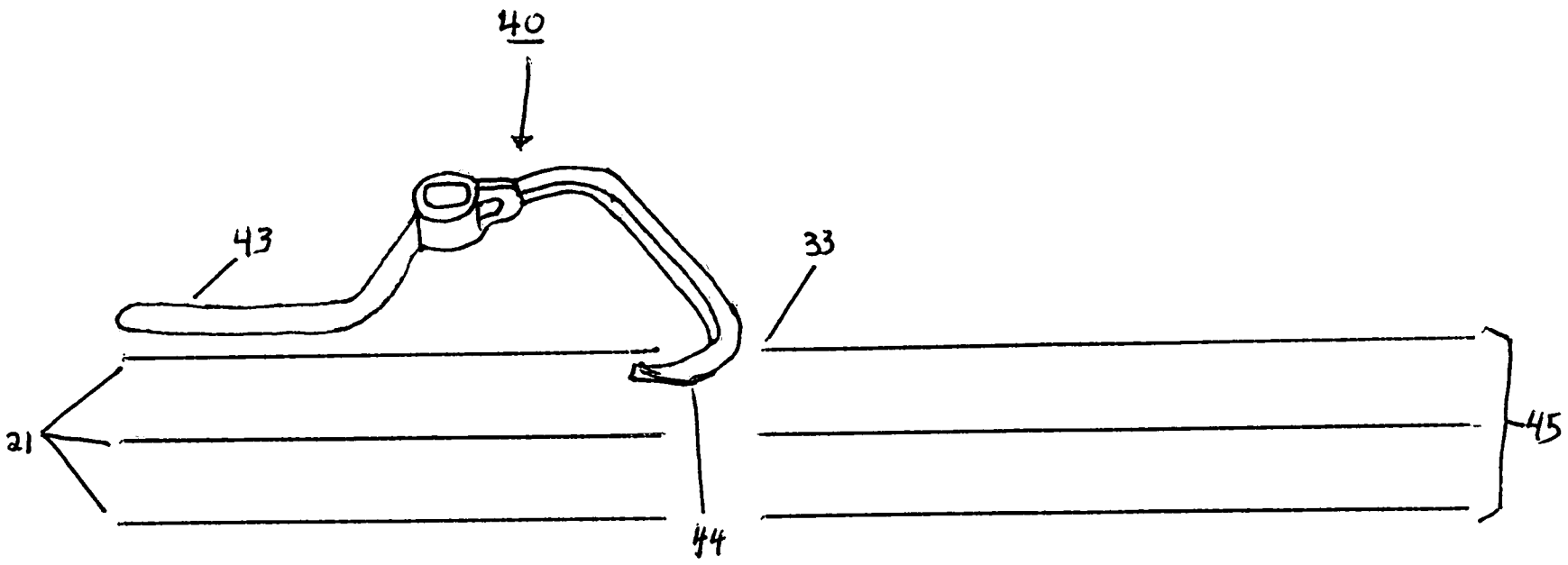
FIG. 5 is a side view illustrating how the Combination Pry Bar/Hook component is inserted w order to pry apart and separate a guardrail panel from other guardrail panels.

FIG. 5 presents a view of the Combination Pry Bar/Hook 40 positioned relative to Guardrail Stack 45 for the purpose of separating one Highway Guardrail Panel 21 from the others. The Prying Element of Combination Pry Bar/Hook 44 is inserted into Guardrail Attachment Slot 31 The shape of the Limiter Element of Combination Pry Bar/Hook 43 prevents the Prying Element from being inserted at an angle, relative to the Highway Guardrail Panel 21, in which it can be attached to more than one panel. Limiter Element 43 also functions as a handle for maneuvering the Combination Pry Bar/Hook 40. The handle is lifted in such a way that the Prying Element separates the top Highway Guardrail Panel 21 from other panels 21. At the same time that the panel is raised and separated from the others, the Guardrail Hook Assembly can be placed onto the edge of the guardrail panel.

Figure 6A:
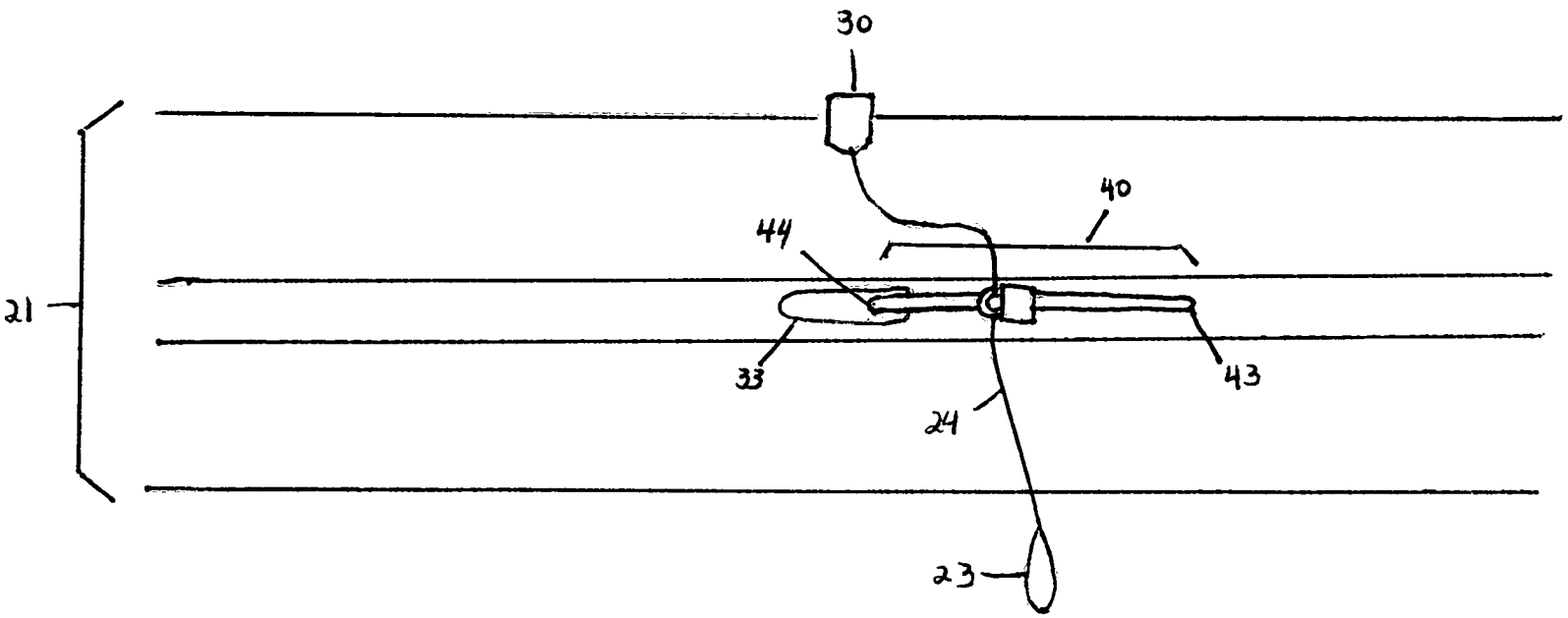
FIG. 6A is a top view of the Combination Pry Bar/Hook positioned for separating a guardrail panel as well as the placement of the guardrail hook assembly.
Figure 6B:
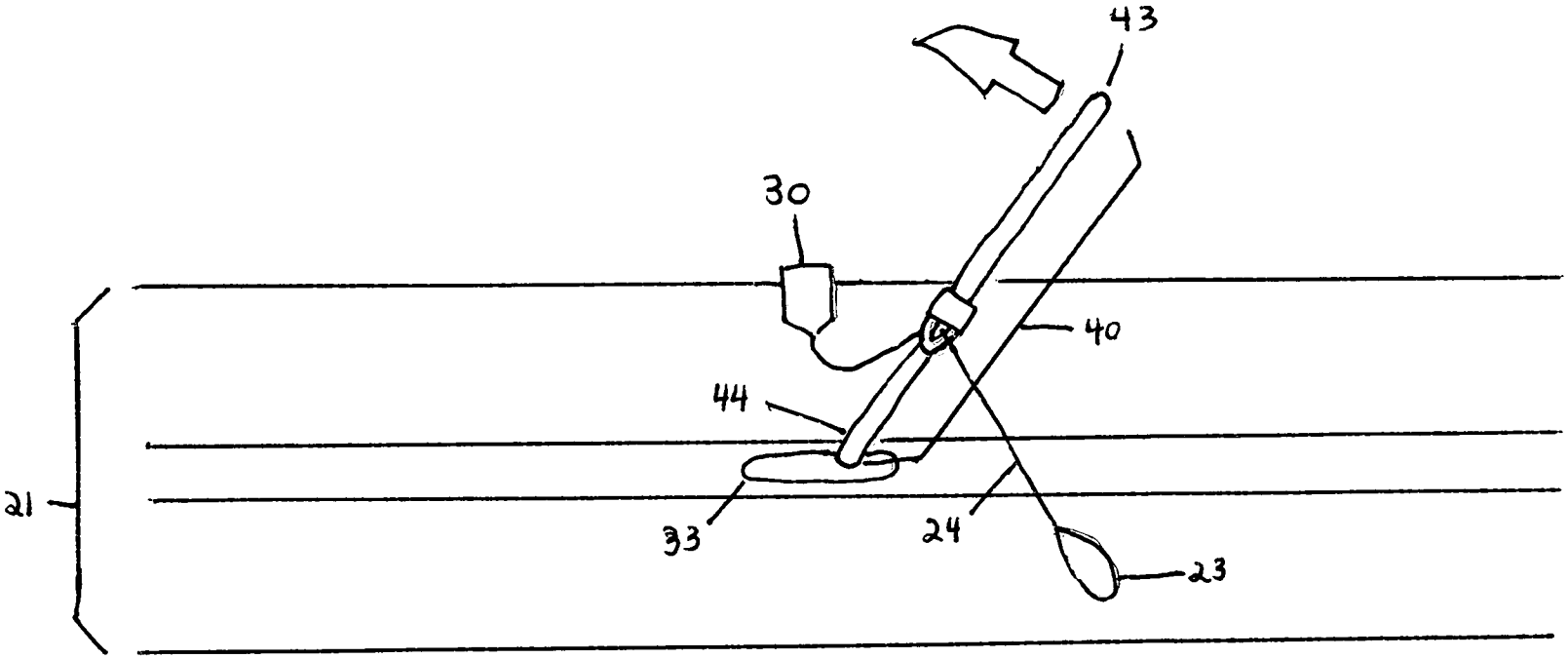
FIG. 6B is a top view showing the Combination Pry Bar/Hook being rotated into the lifting position.
Figure 6C:
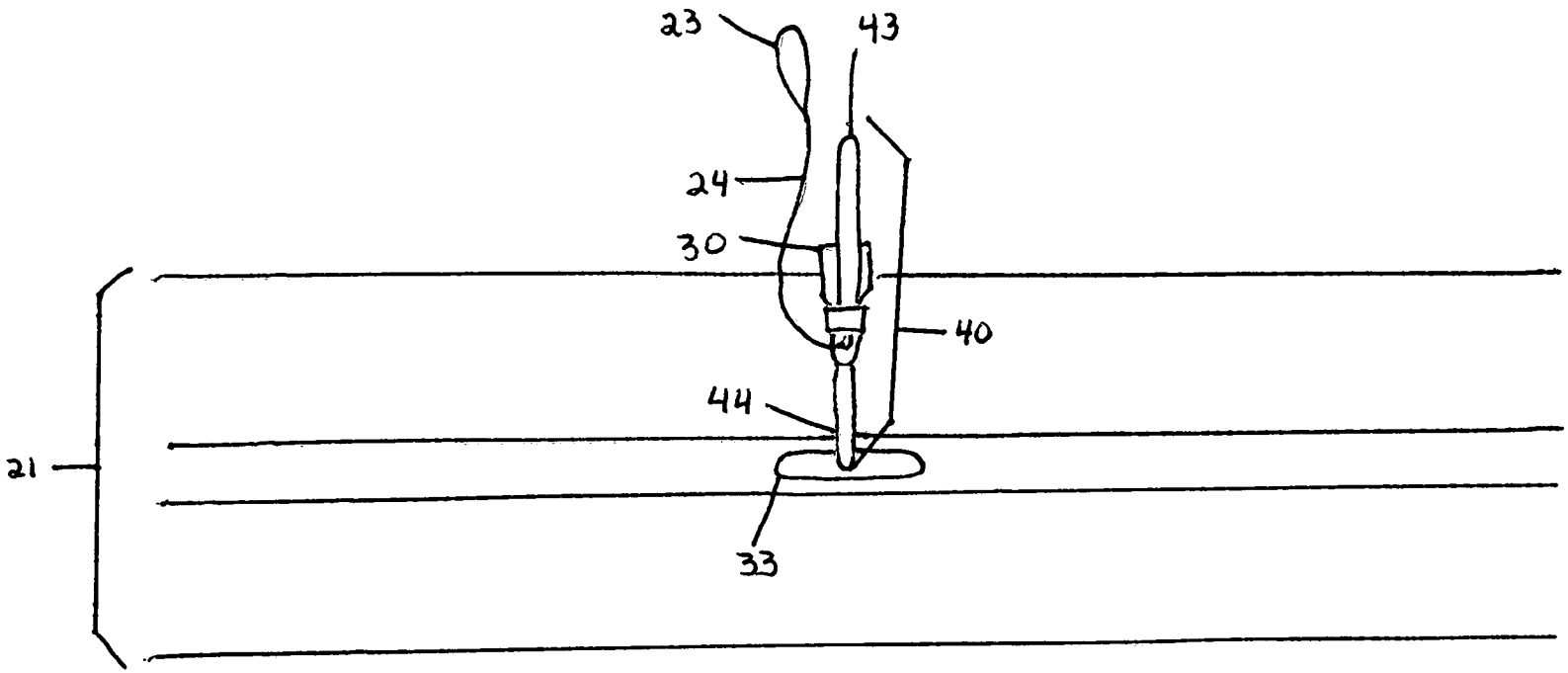
FIG. 6C is a top view showing the Combination Pry Bar/Hook and the guardrail hook assembly positioned for lifting.

FIG. 6 (A, B and C, respectively) present views of steps in attaching the Combination Pry Bar/Hook 40 to Highway Guardrail Panel 21, (A) prying the panel away from other panels, (B) rotating the present invention into a configuration for lifting, and (C) completing the attachment of the Combination Pry Bar/Hook and the Guardrail Hook Assembly 30 onto the guardrail panel.

Figure 7:
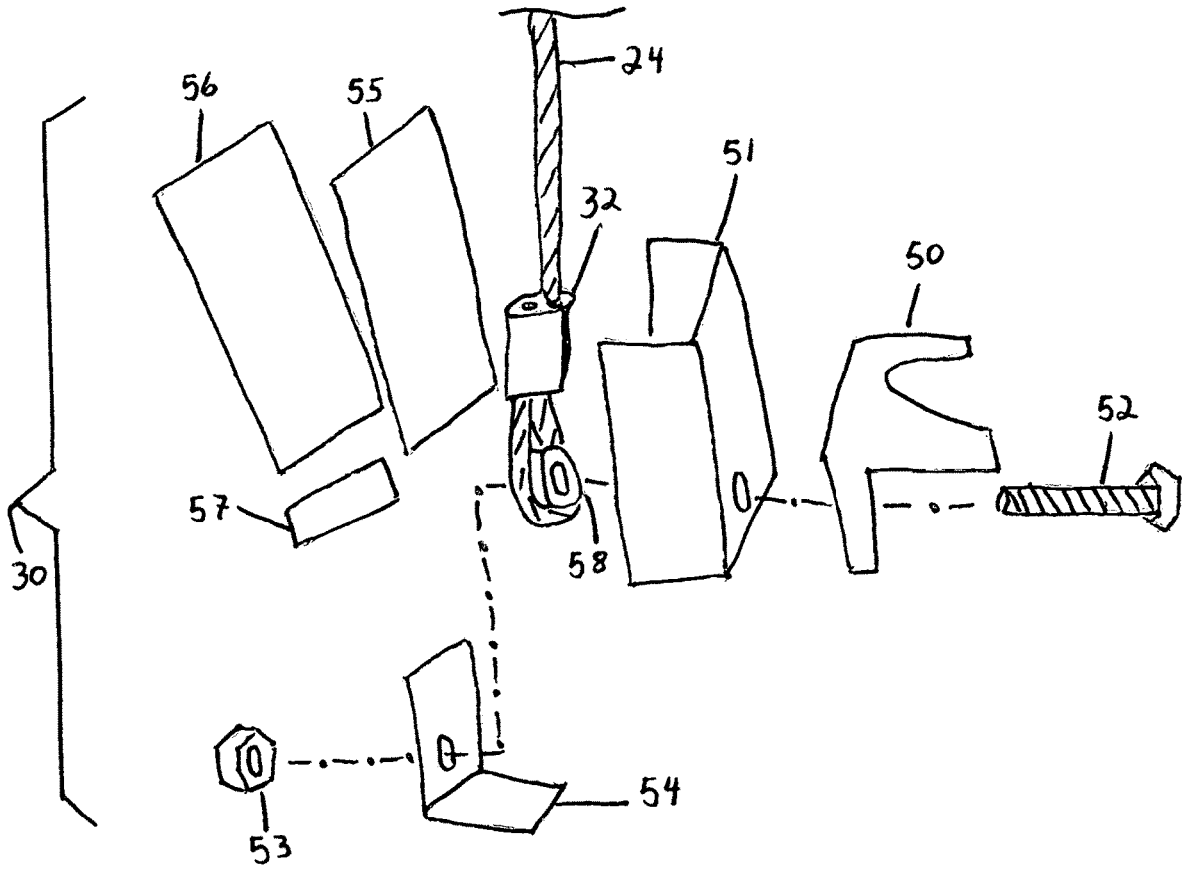
FIG. 7 is a side view of the disassembled Guardrail Hook Assembly—Alternative Embodiment

FIG. 7 presents a view of the disassembled Guardrail Hook Assembly—alternative embodiment. The individual components of this assembly are detailed in FIG. 8. Notice that several components of the Guardrail Hook Assembly 30 are held together by the Bolt 52 and Nut 53. This feature allows the user to separate Cable 24 from the Guardrail Hook Assembly and replace the cable if necessary.

Figure 8:
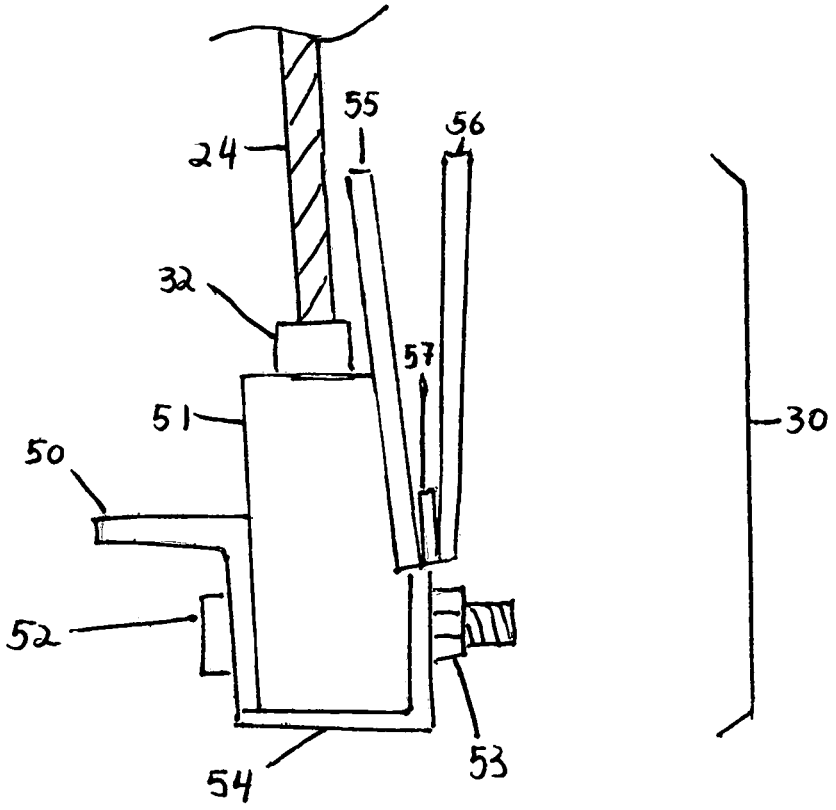
FIG. 8 is a side view of the assembled Guardrail Hook Assembly—Alternative Embodiment.

FIG. 8 presents a view of the assembled Guardrail Hook Assembly 30—alternative embodiment. It shows the Handle Saddle 50, Channel 51, Back Plate 54 held together by Bolt 52 and Nut 53. Bolt and Nut also hold Ring 58 and Cable 24 in place. V-Plate Top 55, V-Plate Bottom 56 and V-Plate Spacer 57 are welded onto Channel 51.

Although the present invention has been described with reference to preferred embodiments, modifications and variations can be made and still be within the scope of the invention. No limitation with respect to the specific embodiments disclosed herein is intended or should be inferred. Each apparatus embodiment described herein has numerous equivalents.

I claim:

1. A combination prying and lifting device comprising:

a combination pry bar/hook comprising a limiter element at a first end, a prying element at a second end, a barrel located between the first end and the second end, and a cable guide attached to the barrel; and a guardrail hook assembly comprising a V plate top, a V plate bottom, a V plate spacer, and a back plate; and, a cable passing through the cable guide and redirected around the barrel, wherein the cable is connected at one end to the guardrail hook assembly with a bolt and a nut and at the other end forms an upper end loop, and wherein the prying element is configured to engage one side of a guardrail and the guardrail hook assembly is configured to engage the other side of the guardrail.

2. The combination prying and lifting device of claim 1, further including the upper end loop which functions to facilitate lifting by a secondary lifting device.

3. The combination prying and lifting device of claim 1, wherein the prying element at its second end for insertion into and attachment to the guardrail to be lifted, the guardrail hook assembly to grasp the edge of the guardrail to be lifted and the cable guide for encircling the cable.

4. The combination prying and lifting device of claim 1, wherein the cable guide is a loop, and the cable is threaded through said loop, the cable having at one end the guardrail hook assembly, and having at its other end the upper end loop, said guardrail hook assembly configured to grasp the edge of the guardrail to be lifted.

5. The combination prying and lifting device of claim 1, wherein the prying element is configured to be inserted into and attached to a hole in the guardrail to be lifted and supported.

6. The combination prying and lifting device of claim 1, wherein the cable guide protects said cable from being damaged by bending or crimping.

7. The combination prying and lifting device of claim 1, wherein positioning of said cable guide and prying element is capable of holding the lifted guardrail panel plumb.

8. The combination prying and lifting device of claim 1, wherein the cable is a coated wire rope cable.

9. The combination prying and lifting device of claim 1, wherein the guardrail hook assembly is configured to grasp the edge of the guardrail panel.

10. The combination prying and lifting device of claim 1, wherein the cable is made of flexible material, cable, or roller chain.

11. The combination prying and lifting device of claim 1, wherein said upper end loop functions to protect the cable from damage by abrasion, crimping, and bending.

* * * * *